United States Patent [19]

Griffith

[11] Patent Number: 4,645,034

[45] Date of Patent: Feb. 24, 1987

[54] DESCENT SYSTEM

[76] Inventor: Selman D. Griffith, 4728 Southshore Dr., Metairie, La. 70002

[21] Appl. No.: 748,798

[22] Filed: Jun. 26, 1985

[51] Int. Cl.[4] ..... A62B 1/10

[52] U.S. Cl. ..... 182/231; 182/236; 182/5; 182/71; 182/72

[58] Field of Search ..... 182/231-240, 182/5-7, 71, 72, 76, 191-193; 188/65.1-65.5

[56] References Cited

U.S. PATENT DOCUMENTS

| | | | |
|---|---|---|---|
| 260,722 | 7/1882 | Wilson | 182/193 |
| 304,603 | 9/1884 | Bott | 182/5 |
| 506,707 | 10/1893 | Matts | 188/65.3 |
| 1,149,616 | 8/1915 | Bell | 182/240 |
| 2,561,832 | 7/1951 | Wilson | 182/235 |
| 3,340,964 | 9/1967 | Glover | 188/65.4 |
| 3,750,612 | 8/1973 | D'Agostino | 188/65.4 |
| 4,506,760 | 3/1985 | Baker | 182/5 |

FOREIGN PATENT DOCUMENTS

| | | | |
|---|---|---|---|
| 18302 | 10/1980 | European Pat. Off. | 182/5 |
| 2024912 | 1/1980 | United Kingdom | 188/65.5 |

*Primary Examiner*—Reinaldo P. Machado
*Assistant Examiner*—A. Chin-Shue
*Attorney, Agent, or Firm*—C. Emmett Pugh & Associates

[57] ABSTRACT

A descent apparatus to control the descent of people or materials from physical heights, for example, buildings, aircraft, ships, trees or mountains and may be used for business, pleasure, and military purposes, under routine or emergency circumstances. The apparatus employs a movable lever arm spring bias toward the braking disposition which influences the amount of friction between various sections of the cable used for lowering as the various sections of the cable interactively contact one another in opposed directions about multiple rollers.

4 Claims, 3 Drawing Figures

DESCENT SYSTEM

BACKGROUND OF INVENTION

1. Field of Invention

The present invention relates to improvements in an apparatus for lowering people and material from physical heights. In particular, this invention advances a system incorporating a movable lever arm which is spring biased toward the braking disposition for influencing the amount of friction between various sections of cable used in lowering as the various sections of cable interactively contact one another in opposed directions about strategically placed multiple rollers.

2. Prior Art

The desire to be able to lower both people and materials from physical heights for business, recreational and military purposes under routine and emergency circumstances has been long recognized. The usefulness of such a lowering device has resulted in the issuance of the following related patents:

| Patent No. | Patentee(s) | Issue Date |
|---|---|---|
| G. W. Eyler | 195,354 | September 18, 1877 |
| J. H. Burks | 288,304 | November 13, 1883 |
| C. C. Halstead | 648,404 | May 1, 1900 |
| E. A. Meaders | 797,903 | August 22, 1905 |
| W. D. Wylie | 2,515,325 | July 18, 1950 |
| F. A. Thoennes | 2,585,876 | February 12, 1952 |

The present invention is an improvement over the prior art in that the present invention allows for the lowering of materials from physical heights such as buildings, aircraft, ships, trees, mountains, or other structures for business, pleasure, or military purposes under routine and emergency circumstances, as well as the lowering of an individual. Whereas the prior art taught only the lowering of an individual.

Further, the present invention is an improvement over the prior art in that it teaches the incorporation of a lever arm which influences the amount of friction between various sections of cable used in the lowering process as the various sections of cable interactively contact one another in opposed directions. This lever is under the control of the user of the apparatus and is spring biased toward the braking disposition. If the user of the apparatus releases the lever and the lever is under the full influence of the spring, the movement of the cable will cease and the apparatus will remain stationary. This lever functions by altering the relative position of the rollers about which the cable passes during the lowering process, thereby altering the interactive contact of the various cable sections.

SUMMARY DISCUSSION OF THE INVENTION

It is an object of the present invention to provide an apparatus to control the descent of people or material from physical heights for any purpose under routine or emergency circumstances.

It is another object of the present invention to provide an apparatus for the lowering of people or material from physical heights which contains a means controlled by the user which influences the braking mechanism of the apparatus, thereby enabling the user to exercise control over the lowering of the people or materials.

It is still another object of the present invention to provide an apparatus for the lowering of people or materials from physical heights which incorporates a braking mechanism which functions by means of altering the relative position of the rollers about which the cable used in lowering passes, thereby altering the angular degree of contact between the various sections of cable as they interactively contact one another in opposed directions.

It is still another object of the present invention to provide an apparatus for lowering people or materials from physical heights which incorporates a braking mechanism which is biased toward the braking disposition and will stop the descent of the apparatus if the braking mechanism is released by the operator.

BRIEF DESCRIPTION OF THE DRAWINGS

The objects and advantages of the present invention and a full understanding therefore may be had by referring to the following detailed description and the claims taken together with the accompanying drawings, briefly described below in which like parts are given like reference numerals:

DETAILED DESCRIPTION OF THE PREFERRED EXEMPLARY EMBODIMENT(S)

Figure 1:
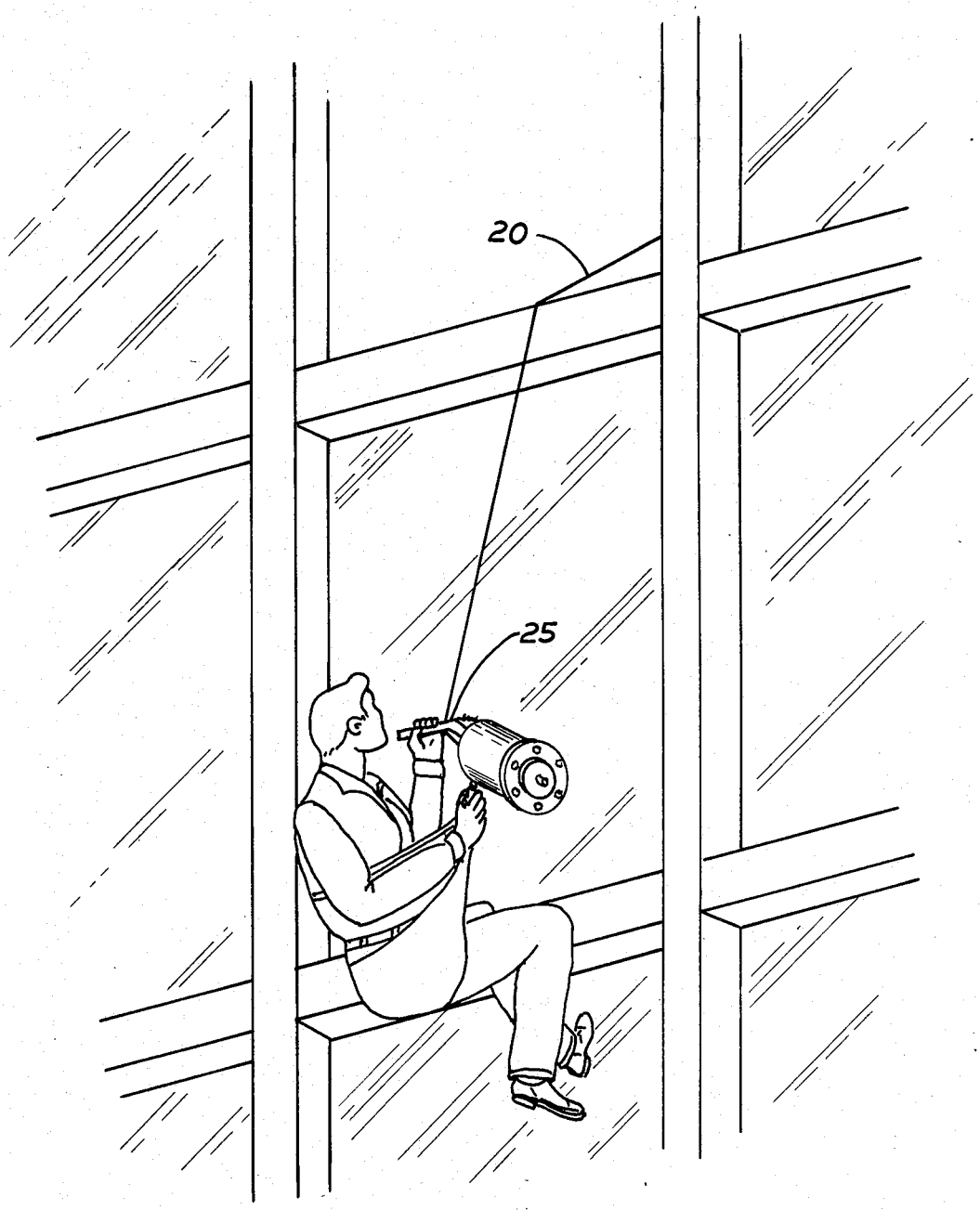
FIG. 1 is a perspective view of the preferred embodiment of the present invention depicting the apparatus in use as a device for lowering a person.

Referring to FIG. 1 there is shown the preferred embodiment of the present invention in use to lower a person from a physical height. The user can be observed controling the rate of descent by means of the lever 25 which alters the relative position of the rollers about which the cable 20 passes, thereby varying the friction between the various sections of the cable as they interactively contact one another in opposed directions about the rollers.

Figure 2:
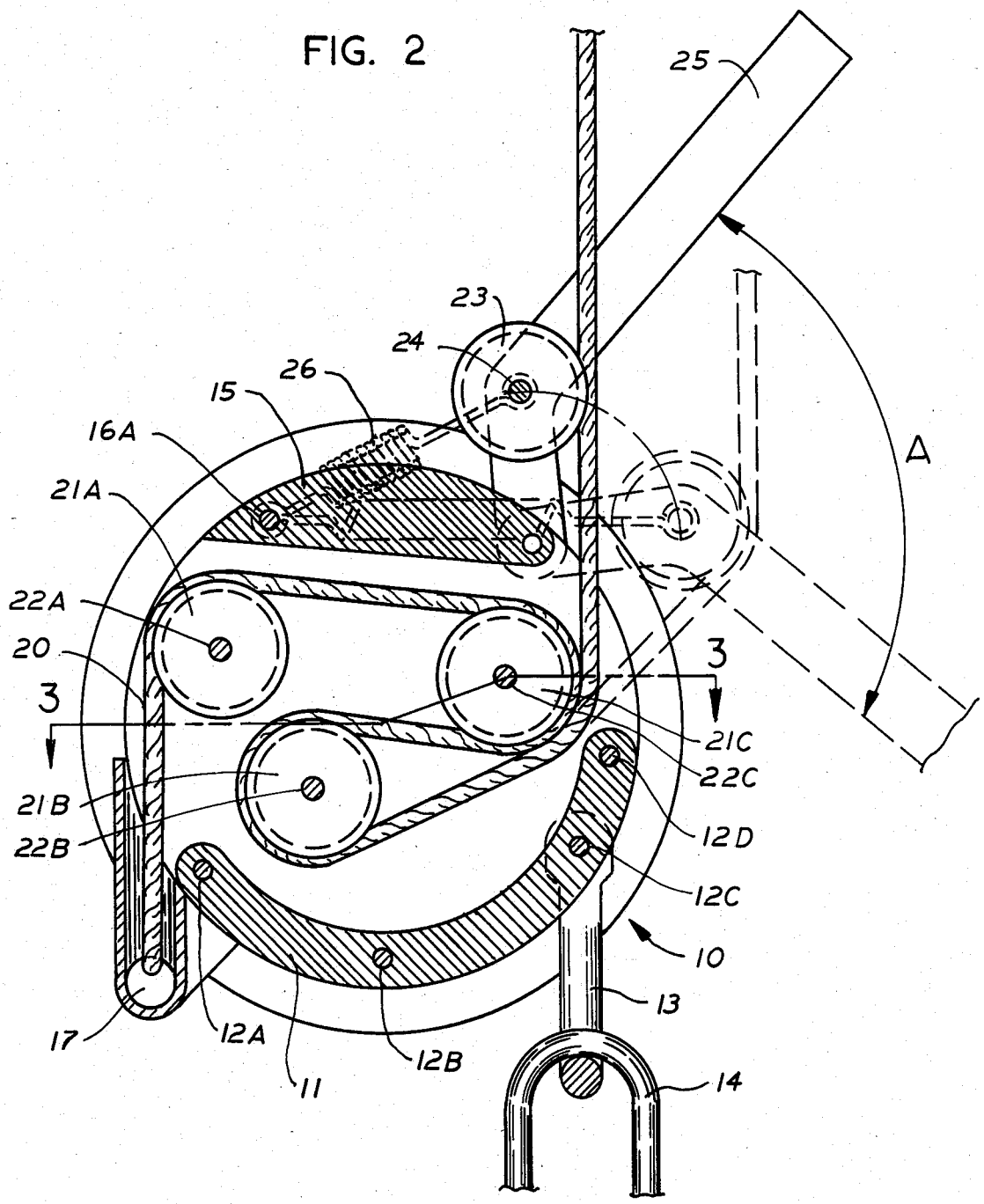
FIG. 2 is a side sectional view of the preferred embodiment of the present invention which reveals the rollers about which the cable which is used for lowering passes and the path of said cable as it passes through the apparatus.

Referring to FIG. 2 there is shown the body 10 of the apparatus. Within the body 10 is contained a plurality of free-wheeling rollers 21A, 21B, 21C, which freely rotate about their mountings 22A, 22B, 22C, respectively, as the cable 20 passes over them. As can be seen in FIG. 2, roller 21B is located below and between the other two, upper rollers 21A and 21C.

Roller 21A is positioned to guide the cable 20 for a smooth transition as it passes from the storage spool through tube 17 in route to snubber or braking roller 21C. The cable 20 passes about roller 21C to roller 21B.

Roller 21B provides a means for reversing the cable 20 to permit it to once again pass across roller 21C in an opposed direction to its initial pass over roller 21C, thereby creating interactive contact between various sections of the cable 20 in opposed directions. This creates friction between the various sections of the cable 20, which results in a snubbing action, thereby creating a braking affect upon the rate of movement of the cable 20, which influences the rate of descent of the person or material being lowered from the physical height by the apparatus.

The body 10 is fitted with a bracket 15 by means of a plurality of securing devices 16A, 16B, for example, pins. A lever 25, located adjacent to, outboard of and above snubbing roller 21C, is attached to the bracket 15 by means of one of the bracket securing device or pivot pin 16B. A roller 23 is attached to the lever 25 by means of securing device 24, for example, a pin. A spring 26 is fitted to the lever 25 at the securing device 24 which attaches the roller 23 to the lever arm 25. The opposite end of the spring 26 is attached to the securing device 16A of the bracket 15.

The lever 25 is operable by the user of the apparatus and is pivotable through an arc A. When the user pulls lever 25 down through arc A in opposition to the bias of the spring 26, the degree of interactive contact between various sections of the cable 20 about roller 21C is decreased. By this action the user decreases the snubbing affect of the cable 20 as the various sections of the cable 20 interactively contact one another in opposed directions, thereby decreasing the braking mechanism and accelerating the rate of lowering of the person or material being lowered from the physical height by the apparatus.

If the lever 25 is released by the user, the spring 26 will draw lever 25 through arc A, resulting in an increase in the interactive contact between the various sections of the cable 20 as the various sections of the cable 20 interactively contact one another in opposed directions. This increases the snubbing action and stops the descent of the people or materials being lowered by the apparatus.

The body 10 is also fitted with a bracket 11 by means of a plurality of securing devices 12A, 12B, 12C, 12D. An attachment device 13 is attached at one of the securing devices 12C. A clevis 14 may be attached to the attachment device 13 to support a sling in which a person would ride to use the device to descent from a physical height. Alternatively, the clevis 14 may be connected to the attachment device 13 and used to secure the apparatus to the physical height for the lowering of materials or another person from the physical height. When the apparatus is used to lower a person operating the apparatus from a physical height, the cable 20 is secured to the physical height, and when the device is used to lower material or another person from a physical height the material to be lowered is attached to the cable 20.

Figure 3:
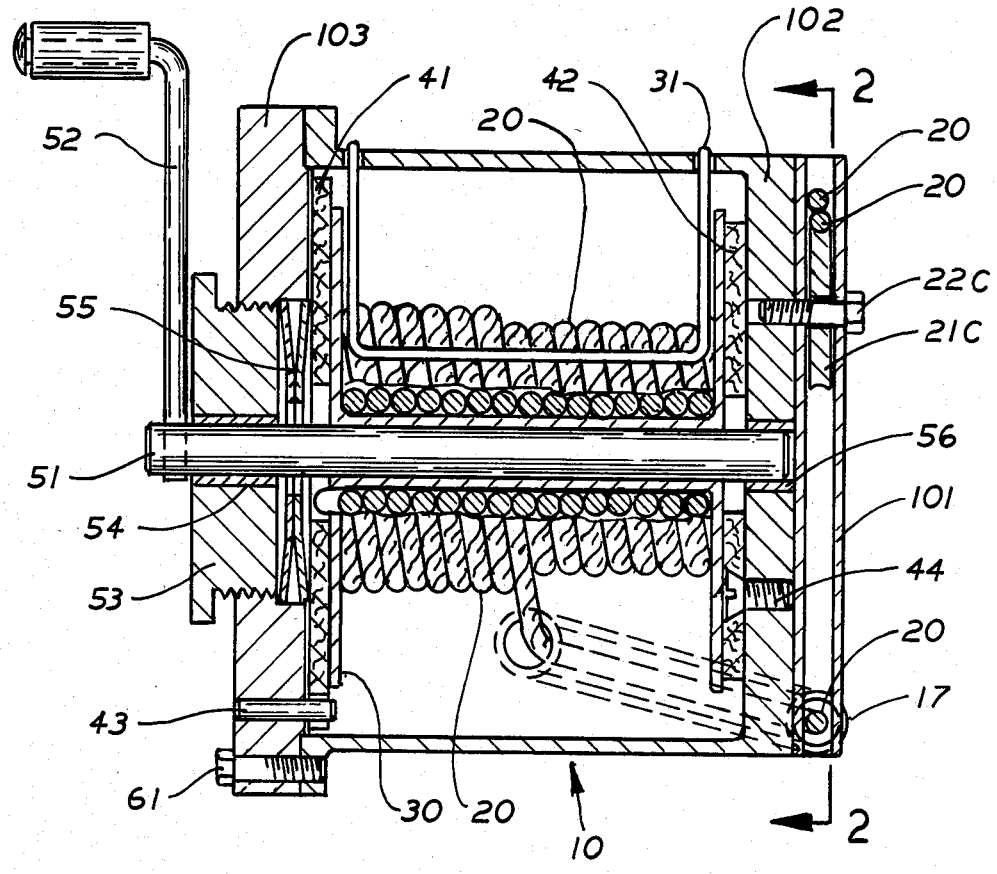
FIG. 3 is a front sectional view of the preferred embodiment of the present invention taken along section lines 3.3 of FIG. 2 which reveals the spool for cable storage, friction discs which influence the rotation of the spool, thereby serving as a drag brake to assist in the control of descent, and the crank mechanism for rewinding the cable upon the spool after use.

Referring to FIG. 3 there is shown a sectional view of the preferred embodiment of the present invention which reveals a spool 30 for storing the cable 20 within the body 10 of the apparatus. The spool 30 is fitted upon a shaft 51 which is mounted at one end in a bushing 56, which in turn is mounted in the spool assembly 102 of the body 10. The opposite end of the shaft 51 is fitted with a spring washer 55, which is held in place by a drag adjustment 53 which is threaded into the end plate assembly 103 of the body 10. The drag adjustment 53 is fitted with a bushing 54 which receives the opposite end of the shaft 51, thereby affecting the alignment of the shaft 51 and the spool 30 within the body 10.

A handle 52 is removeably fitted to the shaft 51 for rewinding the cable 20 upon the spool 30, once the lowering operation has been completed. A friction disc 42 is removeably attached to the spool assembly 102 of the body 10 by means of an anti-rotation pin 44. Likewise a friction disc 41 is removeably attached to the end plate assembly 103 of the body 10 by means of an anti-rotation pin 43.

The body 10 of the apparatus is assembed by sliding the spool 30 over the shaft 51. The shaft 51 is then inserted into the bushing 56, which brings the spool 30 in contact with the friction disc 42. The spring washer 55 is slid over the shaft 51, and the end plate assembly 103 is fixedly attached to the spool assembly 102 by means of a plurality of securing device 61, for example, a plurality of bolts. The drag adjustment 53 containing the bushing 54 is slid over the shaft 51, and the drag adjustment 53 is threaded into the end plate assembly 103. As the drag adjustment 53 is threaded into the end plate assembly 103, the spring washer 55 forces the friction disc 41 against the spool 30. The spool 30 slides along the shaft 51 in an axial direction and is placed in contact with the friction disc 42.

By adjusting the degree to which the drag adjustment 53 is threaded into the end plate assembly 103, the degree of friction between friction disc 41 and spool 30 and friction disc 42 and spool 30 is adjusted. The degree of friction between the friction disc 41 and spool 30 and friction disc 42 and spool 30 influences the rate of descent of the apparatus during the lowering operation by influencing the rate at which the spool 30 may rotate, thereby affecting the rate at which the cable 20 can be paid out from the body 10 of the apparatus.

The roller assembly 101 of the body 10 is attached to the spool assembly 102 by means of the securing device 22C, for example, a bolt, which also secures roller 21C within the roller housing 101. The spool assembly 102 is fitted with a spring bail 31 to control the wrap and the unwrap of the cable 20 from the spool 30.

Besides a cable 20, some other form of flexible linear member could be used, such as for example a rope, plastic line, etc. Additionally, rather than a spring 26, some other biasing member, such as for example an hydraulic system, could be used. Although three free-wheeling rollers 21A–C are preferred with only one roller 21C having the cable 20 interactively contacting itself in opposite directions, have been found to be adequate, other combinations are of course possible. The foregoing are of course only exemplary of the many possible variations in design or arrangement, etc.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A descent apparatus for lowering people or material from physical heights, comprising:

(a) a body;

(b) a plurality of rollers rotatably attached within said body;

(c) a flexible linear member contained within said body which pases over said rollers with various sections of said flexible linear member interactively contacting one another in opposed directions when passing about at least one of said rollers as said flexible linear member exits said body;

(d) a braking means attached to said body for influencing the degree of interactive contact between the various sections of said flexible linear member;

(e) a storage means contained within said body to receive said flexible linear member for storing said flexible linear member within said body;

(f) a friction means mounted within said body which comes in contact with said storage means for controlling the rate at which said flexible linear member exists said body;

(g) a retrieval means for returning said flexible linear member storage means contained within said body, (h) a lever rotatably attached to said body;

(i) a roller rotatably attached to said lever which engages said flexible linear member as said flexible linear member exists said body, influencing the degree of interactive contact between the various sections of said flexible linear member within said body as said flexible linear member passes over said rollers within said body, the various sections of said flexible linear member interactively contacting one another in opposed directions, said roller being attached to said lever external of said body and engaging said flexible linear member external to said body;

(j) a biasing member attached at one end to said lever and at the other end to said body biasing said lever toward the maximum degree of interactive contact between the various sections of the flexible linear member as said flexible linear member passes over said rollers within said body as said linear member exits said body.

2. The descent apparatus of claim 1, wherein said storage means is comprised of:

(a) a shaft rotatably mounted in said body;

(b) a spool axially mounted on said shaft;

(c) a bail flexibly mounted above said spool and extending into the receiving area of said spool to control the lay of said flexible linear member upon said spool;

(d) a handle removably mounted to said shaft to rotate said shaft and said spool mounted on said shaft to retrieve said flexible linear member; and (e) a securing means attached to an end of said flexible linear member for securing the end of said flexible linear member to said spool to eliminate the relative movement of said end of said flexible member with regard to said spool, thereby causing the spool to rotate as said flexible linear member exits said body and permitting the retrieval of said flexible linear member by rotating said spool with said handle.

3. The descent apparatus of claim 1, wherein said friction means is comprised of:

(a) a plurality of friction discs nonrotatably mounted to said body and positioned circumfrentially about said shaft on either side of said spool;

(b) a spring washer axially fitted about said shaft and in contact with the plurality of friction discs at one side of said spool; and (c) an adjustment means axially fitted about said shaft and in contact with said washers for compressing said washer against said friction disc to influence the degree of resistance to rotation of said spool.

4. The descent apparatus of claim 1, wherein said retrieval means is comprised of:

(a) a handle removably mounted to said storage means to rotate said storage means to retrieve said flexible linear member; and (b) a securing means attached to an end of said flexible linear member for securing the end of said flexible linear member to said storage means to eliminate the relative movement of said end of said flexible member with regard to said storage means, thereby permitting the retrieval of said flexible linear member by rotating said storage means with said handle.

* * * * *